US007199091B2

(12) United States Patent
Takashima

(10) Patent No.: US 7,199,091 B2
(45) Date of Patent: Apr. 3, 2007

(54) PHOTORESIST STRIPPER

(75) Inventor: Masayuki Takashima, Tsukuba (JP)

(73) Assignee: Dongwoo Fine-Chem Co., Ltd., Iksan, Jeonbuk (KR)

( * ) Notice: Subject to any disclaimer, the term of this patent is extended or adjusted under 35 U.S.C. 154(b) by 0 days.

(21) Appl. No.: 11/110,533

(22) Filed: Apr. 19, 2005

(65) Prior Publication Data

US 2005/0250660 A1 Nov. 10, 2005

(30) Foreign Application Priority Data

Apr. 19, 2004 (JP) ..... 2004-122636

(51) Int. Cl.
*C11D 1/02* (2006.01)
*C11D 3/26* (2006.01)
*C11D 3/30* (2006.01)

(52) U.S. Cl. ..... 510/176; 510/245; 510/257; 510/259; 510/499; 510/504; 134/1.2; 134/1.3

(58) Field of Classification Search ..... None
See application file for complete search history.

(56) References Cited

U.S. PATENT DOCUMENTS 6,265,309 B1 * 7/2001 Gotoh et al. ..... 438/637
6,514,352 B2 * 2/2003 Gotoh et al. ..... 134/3
6,599,370 B2 * 7/2003 Skee ..... 134/3
6,777,380 B2 * 8/2004 Small et al. ..... 510/176
6,916,772 B2 * 7/2005 Zhou et al. ..... 510/201
2002/0128164 A1 * 9/2002 Hara et al. ..... 510/175
2003/0113673 A1 * 6/2003 Ahn et al. ..... 430/331
2003/0130149 A1 * 7/2003 Zhou et al. ..... 510/176
2004/0224866 A1 * 11/2004 Matsunaga et al. ..... 510/175

* cited by examiner

*Primary Examiner*—Gregory R. Del Cotto
(74) *Attorney, Agent, or Firm*—Blakely, Sokoloff, Taylor & Zafman; Stephen M. De Klerk

(57) ABSTRACT

Recently, use is made of copper wiring as the wiring material for semiconductor devices, and of low dielectric constant films as the insulating film between the lines of wiring. In this connection, a photoresist stripper is in need which can inhibit corrosion or damage on the copper wiring or the Low-k film, and which has excellent property of removing ashed photoresist residues. The invention provides a photoresist stripper (hereinafter, referred to as the stripper of the invention) characterized in containing a tertiary amine compound, an alkaline compound, a fluoro compound, and an anionic surfactant; and a process for preparation of semiconductor devices using the stripper of the invention.

6 Claims, No Drawings

PHOTORESIST STRIPPER

CROSS-REFERENCE TO RELATED APPLICATIONS

The present patent application claims priority from Japanese Patent Application No. 2004-122636, filed on Apr. 19, 2004.

TECHNICAL FIELD

The invention relates to a photoresist stripper used in semiconductor devices having copper wiring.

BACKGROUND ART

In the recent technique for formation of wiring in semiconductor devices, the technology of lithography using photoresist is being employed. When holes are formed in the lithographic technology, after the formation of holes, the photoresist is ashed by plasma or the like, and the ashed residues resulting therefrom are removed by a photoresist stripper.

As photoresist strippers known hereinto, there are a stripper containing a tertiary amine compound, a fluoro compound, a metal chelating agent or the like, which acts on the wiring consisting mainly of aluminum (Patent Document 1), a photoresist stripper containing a tertiary amine compound, a chelating agent or the like (Patent Document 3), and the like.

[Patent Document 1] Japanese Unexamined Patent Application No. 2001-508239

[Patent Document 2] Japanese Unexamined Patent Application No. 2001-507073

DISCLOSURE OF THE INVENTION

Problem to be Solved by the Invention

Meanwhile, with the high-performance trend for devices such as transistors or the like, semiconductor devices employ copper wiring as the wiring material and a film of low dielectric constant (hereinafter, referred to as a Low-k film) as an insulating film between the lines of wiring. However, the Low-k film which forms the lateral side of the copper wiring or the holes is very susceptible to corrosion or damage due to chemical reagents, and such a photoresist stripper as described above cannot be said to have sufficient property for inhibition of copper wiring corrosion. Further, the removability for the residues in the hole is still to be improved. Under such circumstances, recently there has been a need for a photoresist stripper which can inhibit corrosion or damage on the copper wiring or the Low-k film, and which is also excellent in the removability for the photoresist residues after ashing.

The object of the invention is to provide a photoresist stripper which results in less corrosion or damage on the copper wiring or the Low-k film, and which is also excellent in the removability for the photoresist residues.

CONSTITUTION OF THE INVENTION

Means to Solve the Invention

The inventors carried out an extensive research to discover a photoresist stripper which can solve the above-described problems, and as a result, they discovered that a composition containing a tertiary amine compound, an alkaline compound and a fluoro compound as well as an anionic surfactant has an excellent property for inhibiting damages on copper wiring or Low-k films and has excellent photoresist residue removability, thus eventually accomplishing the invention.

That is, the invention is to provide a photoresist stripper characterized in containing a tertiary amine compound, an alkaline compound, a fluoro compound and an anionic surfactant (hereinafter, referred to as the stripper of the invention), and a process for preparation of semiconductor devices using the stripper of the invention.

EFFECT OF THE INVENTION

According to the invention, it is possible to provide a photoresist stripper which results in less corrosion or damage on the copper wiring or the Low-k film, and which is also excellent in the removability for the photoresist residues.

BEST MODE FOR CARRYING OUT THE INVENTION

Next, the invention will be explained in detail.

The stripper of the invention contains a tertiary amine compound, an alkaline compound, a fluoro compound and an anionic surfactant.

As the tertiary amine compound contained in the stripper of the invention, any generally known compound may be used, and among them, a tertiary amine compound having at least two alkyl groups at the nitrogen atom is preferred.

The tertiary amine compound having at least two alkyl groups at the nitrogen atom may include amine compounds having three alkyl groups, amine compounds having a hydroxylalkyl group in addition to two alkyl groups, amine compounds having a cycloalkyl group in addition to two alkyl groups in the molecule, polyamine compounds having two or more nitrogen atoms in the molecule, and the like.

Here, the alkyl group may be exemplified by an alkyl group having 1–4 carbon atoms, and specifically by a methyl group, an ethyl group, an isopropyl group, an n-propyl group, a butyl group or the like.

Among the aforementioned amine compounds, in detail, the amine compound having three alkyl groups may be exemplified by trimethylamine, triethylamine, dimethylbutylamine or the like; the amine compound having a hydroxylalkyl group in addition to two alkyl groups may be exemplified by N,N-dimethylethanolamine, N,N-diethylethanolamine, N,N-diisopropylethanolamine, N,N-di-n-propylethanolamine or the like; and the amine compound having a cycloalkyl group in addition to two alkyl groups in the molecule may be exemplified by N,N-dimethylcyclohexylamine, N,N-diethylcyclohexylamine, N,N-diisopropylcyclohexylamine, N,N-di-n-propylcyclohexylamine, N,N-dibutylcyclohexylamine or the like. Further, the polyamine compound having two or more nitrogen atoms in the molecule may be exemplified by tetramethylethylenediamine, tetramethylpropanediamine, tetramethylbutanediamine, tetramethylpentanediamine, tetramethylhexanediamine, N,N,N',N",N"-pentamethyldiethylenetriamine, bis(dimethylaminoethyl) ether, tris(3-dimethylaminopropyl)hexahydro-S-triazine or the like.

The stripper of the invention may contain two or more of these tertiary amine compounds.

Among these, dimethylcyclohexylamine, N,N,N',N",N"-pentamethyldiethylenetriamine and bis(2-dimethylaminoethyl)ether are preferred.

The stripper of the invention contains these tertiary amine compounds usually in an amount of up to 5% by weight, preferably 0.001–5% by weight, more preferably 0.001–0.1% by weight, and particularly preferably 0.01–0.05% by weight. If the tertiary amine compound is contained in less than 0.001% by weight or in more than 5% by weight, the anti-corrosion effect against the copper wiring tends to be lowered.

As the alkaline compound contained in the stripper of the invention, mention may be made of, for example, inorganic hydroxides, quaternary ammonium hydroxides, alkanolamines, morpholines, piperazines, hydroxylamines and the like.

As the inorganic hydroxide, mention may be made specifically of, for example, ammonium hydroxide, potassium hydroxide, sodium hydroxide and the like; and as the quaternary ammonium hydroxide, mention may be made of tetramethylammonium hydroxide, tetraethylammonium hydroxide, choline and the like. The alkanolamines may be exemplified by monoethanolamine, diethanolamine, triethanolamine, 2-methylaminoethanol, 2-ethylaminoethanol, N-methyldiethanolamine, 2-(2-aminoethoxy)ethanol, 1-amino-2-propanol, monopropanolamine, dibutanolamine or the like; the morpholine may be exemplified by morpholine, N-methylmorpholine, N-ethylmorpholine or the like; and the piperazine may be exemplified by piperazine, hydroxyethylpiperazine, 2-methylpiperazine, hydroxylamine or the like.

The stripper of the invention may contain two or more of these alkaline compounds.

Among these, preferred are ammonium hydroxide, tetramethylammonium hydroxide, tetraethylammonium hydroxide, choline and the like, and even more preferred are tetramethylammonium hydroxide, tetraethylammonium hydroxide and the like.

When an amine compound such as tertiary alkanolamines, morpholines, piperazines or the like is contained as the tertiary amine compound, the above-described alkaline compounds may not be contained.

The stripper of the invention contains an alkaline compound usually in an amount of 0.01–31% by weight, preferably 0.05–10% by weight, and more preferably 0.1–5.0% by weight. When the concentration is too low, the photoresist removability tends to be lowered; on the other hand, when the concentration is too high, the property to inhibit damage on the copper wiring or the Low-k film tends to be lowered.

The fluoro compound contained in the stripper of the invention may be exemplified specifically by hydrofluoric acid or fluoride salts, and the fluoride salts may include, for example, ammonium fluoride, tetramethylammonium fluoride, tetraethylammonium fluoride and the like.

The stripper of the invention may contain two or more of these fluoro compounds.

The fluoride salts are preferably those other than metal salt, and preferred among them is ammonium fluoride.

The stripper of the invention contains these fluoro compounds in an amount of usually 0.001–5% by weight, preferably 0.01–1% by weight, and more preferably 0.01–0.1% by weight.

When the content of the fluoro compound is smaller than said ranges, the photoresist removability tends to be insufficient; on the other hand, when the content is too high, the property to inhibit damage on the copper wiring or the Low-k film may be lowered.

The stripper of the invention is characterized in that it contains an anionic surfactant. When the stripper of the invention contains other surfactants such as a nonionic surfactant, a cationic surfactant or the like, alone, instead of an anionic surfactant, the photoresist removability to the extent that can be obtained when an anionic surfactant is present is not obtained.

Meanwhile, when an anionic surfactant is contained, other surfactants may be contained if necessary.

As the anionic surfactant, mention may be made of all of generally known anionic surfactants, and preferred among them are those anionic surfactants having two or more anionic functional groups in the molecular structure.

The term anionic functional group as used herein means a group having anionicity in water, and specific examples thereof may include a group forming sulfonic acid (hereinafter, referred to as sulfonic acid group), a group forming sulfuric acid ester (hereinafter, referred to as sulfuric acid ester group), a group forming phosphoric acid ester (hereinafter, referred to as phosphoric acid ester group), a group forming carboxylic acid (hereinafter, referred to as carboxylic acid group) and the like. The stripper of the invention preferably employs an anionic surfactant having a sulfonic acid group or a sulfuric acid ester group.

The anionic surfactant contained in the stripper of the invention may include, for example, a compound having the following structure or salts of these compounds.

Such compound as used herein may be specifically exemplified by a compound having a sulfonic acid group such as alkyldiphenyl ether sulfonic acid as represented by Formula (1), alkylene disulfonic acid as represented by Formula (2), alkylbenzene sulfonic acid as represented by Formula (3), dialkyl succinate sulfonic acid as represented by Formula (4), monoalkyl succinate sulfonic acid as represented by Formula (5), alkylphenoxyethoxyethyl sulfonic acid as represented by Formula (6), the condensate of naphthalene sulfonic acid-formalin as represented by Formula (7), the condensate of phenol sulfonic acid-formalin as represented by Formula (8), the condensate of phenylphenol sulfonic acid-formalin as represented by Formula (9), or the like; by a compound having a sulfuric acid ester group such as polyoxyalkylene alkylphenyl ether sulfuric acid ester as represented by Formula (10), polyoxyalkylene alkyl ether sulfuric acid ester as represented by Formula (11), polyoxyalkylene polycyclicphenyl ether sulfuric acid ester as represented by Formula (12), polyoxyalkylene aryl ether sulfuric acid ester as represented by Formula (13), methyl taurines compound as represented by Formula (14) such as alkylmethyl taurine, acylmethyl taurine, fatty acid methyl taurine or the like; by a compound having a phosphate ester group such as polyoxyalkylene alkyl ether phosphate as represented by Formula (15), polyoxyalkylene alkylphenyl ether phosphate as represented by Formula (16); by a compound having a carboxylic acid group such as fatty acid such as palm oil, oleic acid or the like, sarcosines compound as represented by Formula (17) such as acyl sarcosine, fatty sarcosine or the like; and by a compound having a sulfonic acid and a carboxylic acid such as alkyl sulfosuccinic acid as represented by Formula (18), polyoxyalkylene alkyl sulfosuccinic acid as represented by Formula (19) or the like.

As the compound having a sulfonic acid group, the compounds as represented by the following formulas may be mentioned.

[Formula 1]

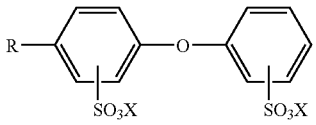

[Formula 2]

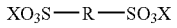

[Formula 3]

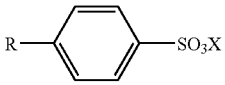

[Formula 4]

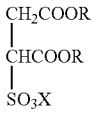

[Formula 5]

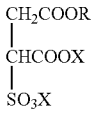

[Formula 6]

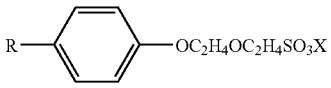

[Formula 7]

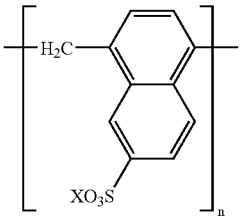

[Formula 8]

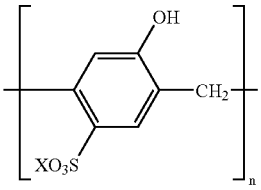

[Formula 9]

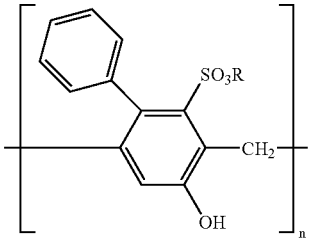

As the compound having a sulfuric acid ester group, the compounds as represented by the following formulas may be mentioned.

[Formula 10]

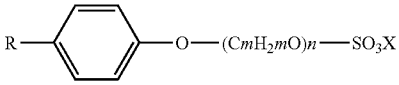

[Formula 11]

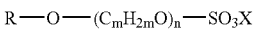

-continued

[Formula 12]

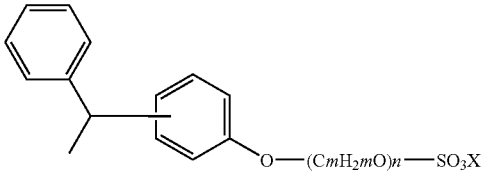

[Formula 13]

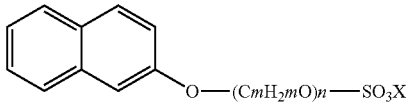

[Formula 14]

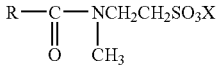

As the compound having a phosphoric acid ester group, the compounds as represented by the following formulas may be mentioned.

[Formula 15]

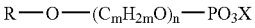

[Formula 16]

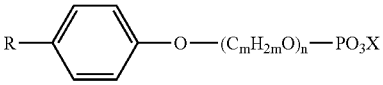

As the compound having a carboxylic acid group, the compound as represented by the following formula may be mentioned.

[Formula 17]

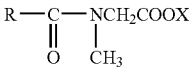

As the compound having a sulfonic acid group and a carboxylic acid group, the compounds as represented by the following formulas may be mentioned.

[Formula 18]

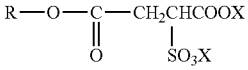

[Formula 19]

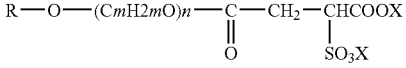

In the above formulas (1)–(19), X represents independently of each other hydrogen, sodium, ammonium, calcium or triethanolamine, and R represents an alkyl group or an alkylene group having 7–20 carbon atoms. Also, m represents an integer between 2 and 4 inclusive, and n represents an integer between 1 and 20 inclusive.

Further, as an anionic surfactant having two or more anionic functional groups in the molecular structure, mention may be made specifically of alkyldiphenylether disulfonic acid, alkylene disulfonic acid, the condensate of naphthalene sulfonic acid-formalin, the condensate of phenol sulfonic acid-formalin, the condensate of phenylphenol sulfonic acid-formalin or salts of these compounds.

Among these, in particular, alkyldiphenyl ether disulfonic acid or its salt is preferred, and more specifically, disodium dodecyldiphenyl ether disulfonate or diammonium dodecyldiphenyl ether disulfonate and diethanolamine dodecyldiphenyl ether sulfonate are more preferred.

The stripper of the invention may contain two or more of these anionic surfactants.

The stripper of the invention contains the anionic surfactant in an amount of usually 0.001–10% by weight, preferably 0.001–1% by weight, and more preferably 0.01–1% by weight. If the content of the anionic surfactant is less than 0.001% by weight, the photoresist removability tends to be lowered; on the other hand, and if the content is more than 10% by weight, foamability increases and it becomes hard to handle.

The stripper of the invention contains water as the solvent.

The stripper of the invention contains water usually in an amount of 40–99.98% by weight, preferably 50–99.98% by weight, more preferably 70–99.98% by weight, and particularly preferably 90–99.98% by weight.

In addition, although the photoresist strippers of prior art have been in general an agent containing organic solvents as the main component, the stripper of the invention contains water as the main component and still exhibits an excellent effect of photoresist stripping. Recently, agents having water as the main component have been on demand for the reason of lowering the environmental load, and the stripper of the invention also preferably contains plenty of water.

Further, the stripper of the invention may contain a water-soluble organic solvent as solvent, if necessary. Such water-soluble organic solvent as used for the purpose may be, for example, general alcohols such as methanol, ethanol, isopropyl alcohol or the like, glycols such as ethylene glycol, ethylene glycol monomethyl ether, ethylene glycol monoethyl ether, ethylene glycol monoisopropyl ether, ethylene glycol monobutyl ether, diethylene glycol, diethylene glycol monomethyl ether, diethylene glycol monoethyl ether, diethylene glycol monoisopropyl ether, diethylene glycol monobutyl ether or the like, N-methyl-2-pyrrolidone, dimethyl sulfoxide or the like.

When these water-soluble organic solvents are contained, the content is in the range of 5% to 30% by weight with respect to the total amount of the stripper of the invention.

Further, the stripper of the invention may contain other components if necessary, within the scope of not deviating from the purpose of the invention.

Such other components may include, for example, various surfactants such as nonionic or cationic surfactants, aqueous hydrogen peroxide, defoamer and the like.

Here, nonionic surfactants may include the surfactants of polyoxyalkylene alkyl ethers, polyoxyalkylene alkylphenyl ethers, polyoxyalkylene glycol fatty acid esters, polyoxyalkylene sorbitol fatty acid esters, sorbitan fatty acid esters, polyoxyalkylene sorbitan fatty acid esters or the like.

Cationic surfactants may include the surfactants of alkyltrimethylammonium salts, alkylamidoamines, and alkyldimethylbenzylammonium salts.

As the defoamer, mention may be made specifically of, for example, emulsifiers such as silicones, polyethers, special nonionics, fatty acid esters or the like, and water-soluble organic compounds such as methanol, ethanol, 1-propanol, 2-propanol, 2-methyl-1-propanol, acetone, methyl ethyl ketone or the like.

When the stripper of the invention contains these other components, the total amount is usually in the range of 0.01%–5% by weight, and preferably 0.1%–1% by weight.

The stripper of the invention is adjusted by a method equivalent to the generally known method for preparation of photoresist stripper. Specifically, the stripper is obtained by mixing, for example, a solvent with components such as an amine compound, an alkaline compound, a fluoro compound, an anionic surfactant and the like.

Furthermore, the stripper of the invention may be prepared as a stock solution containing relatively high concentrations of the respective components, and the stock solution can be diluted with water to the stripper of the invention of the original concentration at the time of use.

The stripper of the invention is used for a substrate that is used in the preparation of semiconductor devices in which the wiring material connected to elements such as transistor is constituted of copper or a copper alloy having copper as the predominant component.

Here, the copper alloy having copper as the predominant component means copper alloys containing 90% by mass or more of copper and includes copper alloys containing heterogeneous elements such as Sn, Ag, Mg, Ni, Co, Ti, Si, Al or the like. These metals improve the high-speed performance of elements with their property of low resistance, while they are susceptible to corrosion such as dissolution, deterioration or the like in reagents, thus making the effect of the invention conspicuous.

As the method for preparation of semiconductor devices using the stripper of the invention, for example, the following method may be mentioned.

First, an insulating film such as silicon oxide film is formed on the semiconductor substrate onto which elements such as transistor and the like have been formed, and copper wiring is formed on the insulating film using the known CMP technology and lithography technology. Subsequently, a Low-k film or silicon oxide film, silicon nitride film or the like is formed on the copper wiring. Next, after patterning of photoresist by means of lithography technology, the photoresist is used as the mask, and via holes are formed in the dielectric film or the like using the dry etching technology. Subsequently, the photoresist is removed by ashing with oxygen plasma or the like, and again, the residues remaining in the via holes are stripped by means of the stripper of the invention. Then, a film of copper or tungsten is embedded inside the via holes to form an interlayer connecting plug.

Since the copper wiring film is exposed at the opening of the via holes after etching, and the Low-k film is exposed at the inner wall of the holes, the stripper compound is required to have the anti-corrosive action on copper or the property to inhibit damage against the Low-k film. By using the stripper of the invention, it is possible to remove the photoresist residues and etching residues effectively without damaging the copper film or the Low-k film.

As the insulating film that can be treated with the stripper of the invention, mention can be made of the Low-k film which is a recently used interlayer insulating film between the wiring, the silicon oxide film which is a conventional interlayer insulating film, or the like.

The Low-k film which can be the subject of treatment by the stripper of the invention may be anything, regardless of the type of the film or the film-forming method, as long as it is generally known. The Low-k film as used herein conventionally means an insulating film with a relative permittivity of 3.0 or less.

Such Low-k film may be, for example, inorganic films such as FSG (F-containing $SiO_2$), SiOC (carbon-containing $SiO_2$) and SiON(N-containing $SiO_2$); polyorganosiloxane-based films such as MSQ (methylsilsesquioxane), HSQ (hydrogensilsesquioxane), MHSQ (methylated hydrogensilsesquioxane) or the like; aromatic films such as PAE (polyarylether), BCB (divinylsiloxane-bis-benzocyclobutene) or the like; and organic films such as SiLk, porous SiLk or the like.

In particular, the film suitable for the treatment by the stripper of the invention may include SiOC, MSQ, PAE (polyarylether) and the like.

The method for treating the stripper of the invention may include an immersion method in which a semiconductor substrate is directly immersed in the stripper of the invention; a spray method in which the stripper of the invention is sprayed onto 25–50 substrates while rotating them; a single wafer spinning method in which the stripper of the invention is sprayed onto one substrate while rotating it; and the like.

EXAMPLES

Next, the invention will be explained in more detail by the following Example, which is not intended to limit the invention in any way.

Example 1

In the process for via hole formation on the copper wiring, the stripping property and the anti-corrosion property of the stripper of the invention were evaluated.

The sample provided for the evaluation was prepared in the following manner.

First, copper wiring was formed on silicon wafer, and then a SiOC film, which is a Low-k film, was formed thereon by means of the plasma CVD technique. Next, a positive-type photoresist film was formed thereon, exposed and developed to yield a photoresist pattern.

This photoresist film was used as the mask in dry etching of the Low-k film, and via holes were formed. After completion of etching, the photoresist film was subjected to ashing by means of oxygen plasma ashing, and then the stripping treatment was carried out using the stripper of the invention (referred to as Stripper of the invention 1) having the composition as presented in Table 1 and a stripper as described in Patent Document 1 (referred to as Comparative stripper 1), with respect to the sample on which photoresist residues remain attached after ashing.

The stripping treatment was carried out by immersing a sample in the stripper at room temperature for 10 minutes, followed by rinsing with pure water, and the sample was observed at the cross-section by SEM (scanning electron microscopy). The stripping of the photoresist residues in the holes at the bottom of the via holes, the anti-corrosion against the copper wiring exposed at the bottom of the via holes, and the damage on the exposed Low-k film (SiOC) surface were evaluated, and the results are presented in Table 1.

The criteria for evaluation are presented below.

TABLE 1

| | Stripper of the Invention 1 | Comparative Stripper 1 |
|---|---|---|
| N,N,N',N'',N''-Pentamethyldiethylenetriamine | 0.01 wt % | 45 wt % |
| Tetramethylammonium hydroxide | 0.5 wt % | |
| Ammonium fluoride | 0.02 wt % | 5 wt % |
| Diammonium dodecyldiphenyl ether disulfonate *1 | 0.25 wt % | |
| Methyl acetoacetate *2 | | 6 wt % |
| Water | 99.22 wt % | 44 wt % |
| In-hole residue removability | ◎ | X |
| Corrosiveness against copper wiring | ◎ | Δ |
| Damage on Low-k film | ◎ | ◎ |

*1: Anionic surfactant having two or more anionic functional groups in the molecular structure
*2: Metal chelating agent
[Criteria for evaluation]
Residue removability
◎: Very good
○: Good
Δ: Slightly insufficient
X: Insufficient
Corrosiveness against copper wiring
◎: No corrosion
○: Slight corrosion
Δ: Corrosion present
X: Severe corrosion
Damage on Low-k film
◎: No damage
○: Slight damage
Δ: Damage present
X: Severe damage As shown in Table 1, the stripper of the invention 1 had good in-hole residue removability, and did not show any corrosion and damage on the copper wiring and the Low-k film. Meanwhile, in Comparative Stripper 1, the in-hole residue removability was insufficient, and corrosion in the copper wiring was also observed.

Example 2

Using the same samples and the stripper composition as in Example 1, the sample was subjected to single wafer spinning for 1 minute at a flow rate of 150 ml/min of the stripper while rotating at 500 rpm, and then rinsed with water for 10 seconds. Subsequently, the sample was observed at the cross-section by SEM (scanning electron microscopy). The stripping of the photoresist residues in the holes at the bottom of the via holes, the anti-corrosion against the copper wiring exposed at the bottom of the via holes, and the damage on the exposed Low-k film (SiOC) surface were evaluated, and the results are presented in Table 2.

TABLE 2

| | Stripper of the Invention 1 | Comparative Stripper 2 |
|---|---|---|
| N,N,N',N'',N''-Pentamethyldiethylenetriamine | 0.01 wt % | 0.01 wt % |
| Tetramethylammonium hydroxide | 0.5 wt % | 0.5 wt % |
| Ammonium fluoride | 0.02 wt % | 0.02 wt % |
| Diammonium dodecyldiphenyl ether disulfonate *1 | 0.25 wt % | |
| Polyoxyethylene lauryl ether *2 | | 0.25 wt % |
| Water | 99.22 wt % | 99.22 wt % |
| In-hole residue removability | ◎ | X |
| Corrosiveness against copper wiring | ◎ | ◎ |
| Damage on Low-k film | ◎ | ◎ |

*1: Anionic surfactant having two or more anionic functional groups in the molecular structure
*2: Nonionic surfactant with addition of 8 moles of ethylene oxide As shown in Table 2, the stripper exhibited good in-hole residue removability even in the case of treating by sheet-fed spinning, and did not show any corrosion and damage on the copper wiring and the Low-k film. Further, in the case of using a nonionic surfactant, which is different from the surfactant of the invention, the in-hole residue removability was insufficient.

Example 3

A stripper having the composition as presented in Table 3 was adjusted. A sample was prepared by forming a copper layer on a silicon wafer by electroplating, and this sample was immersed in the stripper at room temperature for 1 minute. The amount of etching of the copper layer was determined by measuring the layer thickness before and after etching, and the surface of the copper layer after immersion was observed by SEM (scanning electron microscopy) to examine the conditions of corrosion.

TABLE 3

| | Stripper of the invention 2 | Stripper of the invention 3 | Comparative stripper 3 |
|---|---|---|---|
| Tetramethylammonium hydroxide | 0.5 wt % | 0.5 wt % | 0.5 wt % |
| Ammonium fluoride | 0.02 wt % | 0.02 wt % | 0.02 wt % |
| Diammonium dodecyl-diphenyl ether disulfonate *1 | 0.25 wt % | 0.25 wt % | 0.25 wt % |
| Bis(2-dimethylamino-ethyl) ether | 0.05 wt % | | |
| Dimethylcyclo-hexylamine | | 0.05 wt % | |
| 2-(2-Aminoethyl-amino)ethanol | | | 0.05 wt % |
| Water | 99.18 wt % | 99.18 wt % | 99.1 wt % |
| Amount of etching of copper layer (Å) | 0.6 | 6.1 | 39.4 |
| Corrosiveness against copper layer | Good | Good | Corrosion |

*1: Anionic surfactant having two or more anionic functional groups in the molecular structure As shown in Table 3, in the strippers of the invention 2 and 3 containing bis(2-dimethylaminoethyl)ether, which is an amine compound having at least two alkyl groups at the nitrogen atom, or dimethylcyclohexylamine, the amount of etching of the copper layer is small, and the surface corrosiveness was also good. However, in the Comparative stripper 3 containing an amine compound such as 2-(2-aminoethylamino)ethanol which has no alkyl group at the nitrogen atom, the amount of etching of the copper layer was large, and corrosion was also observed.

What is claimed is:

1. A photoresist stripper comprising:

0.001–0.1% by weight of a tertiary amine compound having a cycloalkyl group in the molecule;

an alkaline compound;

a fluoro compound; and an anionic surfactant having two or more anionic functional groups in the molecular structure.

2. The photoresist stripper according to claim 1, wherein the alkaline compound is at least one selected from the group consisting of quaternary ammonium hydroxides and alkanolamines.

3. The photoresist stripper according to claim 2, wherein the alkaline compound is at least one selected from the group consisting of tetramethylammonium hydroxide, tetraethylammonium hydroxide and choline.

4. The photoresist stripper according to claim 1, wherein the fluoro compound is at least one selected from the group consisting of the salts of hydrofluoric acid and/or fluorides.

5. The photoresist stripper according to claim 4, wherein the fluoro compound is at least one selected from the group consisting of hydrofluoric acid, ammonium fluoride, tetramethylammonium fluoride and tetraethylammonium fluoride.

6. A process for preparation of semiconductor devices, characterized in that upon the preparation of a semiconductor device having copper or a copper alloy which has copper as the predominant component as the wiring material, the device is treated with the photoresist stripper according to claim 1 to remove the photoresist residues.

* * * * *